US009844859B2

(12) United States Patent
Cubillas

(10) Patent No.: US 9,844,859 B2
(45) Date of Patent: Dec. 19, 2017

(54) MULTI-ENGAGEABLE TUBING WRENCH

(76) Inventor: Alberto R. Cubillas, San Ysidro, CA (US)

( * ) Notice: Subject to any disclaimer, the term of this patent is extended or adjusted under 35 U.S.C. 154(b) by 0 days.

(21) Appl. No.: 12/725,387

(22) Filed: Mar. 16, 2010

(65) Prior Publication Data

US 2010/0229692 A1 Sep. 16, 2010

Related U.S. Application Data

(60) Provisional application No. 61/160,593, filed on Mar. 16, 2009.

(51) Int. Cl.

| | |
|---|---|
| ***B25B 13/46*** | (2006.01) |
| ***B25B 13/48*** | (2006.01) |
| ***B25B 23/16*** | (2006.01) |
| ***B25B 13/08*** | (2006.01) |

(52) U.S. Cl.

CPC ..... *B25B 13/463* (2013.01); *B25B 13/08* (2013.01); *B25B 13/48* (2013.01); *B25B 13/481* (2013.01)

(58) Field of Classification Search

CPC ..... B25B 13/08; B25B 13/46; B25B 13/463; B25B 13/48; B25B 13/481; Y10S 81/08

USPC ..... 81/58.2, 177.7, 177.85

See application file for complete search history.

(56) References Cited

U.S. PATENT DOCUMENTS

| | | | | | |
|---|---|---|---|---|---|
| 620,143 | A * | 2/1899 | Johnson | 81/58.2 | |
| 1,350,315 | A * | 8/1920 | Katzmarek | 81/58.2 | |
| 2,578,687 | A * | 12/1951 | Fish | B25B 13/463 | 81/58.2 |
| 2,699,082 | A * | 1/1955 | Viets | 81/58.2 | |
| 3,175,434 | A * | 3/1965 | Bergquist | B25B 13/08 | 81/58.2 |
| 5,471,899 | A * | 12/1995 | Twomlow | B25G 1/043 | 81/60 |
| 5,924,341 | A * | 7/1999 | Brooks | 81/58.2 | |
| 7,146,886 | B1 * | 12/2006 | Wu | B25B 13/04 | 81/177.9 |

* cited by examiner

*Primary Examiner* — Hadi Shakeri
(74) *Attorney, Agent, or Firm* — Donn K. Harms

(57) ABSTRACT

A tubing connector wrench having a rotating hub held by two independent pawls. An open end of the hub and casing of the wrench allows it to engage over a piece of tubing and thereafter be engaged on a tubing connector. The wrench may be employed to turn tubing connectors without removing it for repositioning. The two pawls insure that the hub remains engaged for one way turning of the connector.

9 Claims, 2 Drawing Sheets

MULTI-ENGAGEABLE TUBING WRENCH

This application claims priority to U.S. Provisional Patent No. 61/160,593 filed Mar. 16, 2009 which is incorporated herein in its entirety by reference.

BACKGROUND OF THE INVENTION

1. Field of the Invention

The disclosed device relates to wrenches adapted to turn bolts and bolt-like fasteners. More particularly the disclosed device relates to handle-engaged open-end reversible wrenches configured for engagement over tubing for connector tightening.

2. Prior Art

Open-end reversible ratchet wrenches have become more popular in recent years as costs have declined. Such wrenches replace the static type open-end wrenches which require a constant removal and replacement of the wrench on a bolt, with a bolt-engageable cavity, which will rotate freely in one direction and not in the other.

Such open-ended wrenches conventionally employ a rotatable hub, having nut-engaging interior section communicating through a slot with an opening at the front area of the wrench housing. Rotation of the hub in one direction and a blocking of rotation in the opposite direction, is provided by a ratchet formed by teeth on the peripheral surface of the hub which engage a biased pawl.

However, as the hub rotates, because the open slot portion of the hub, which lacks engaging teeth, is brought into registration with the pawl, rendering it ineffective, two pawls are employed which are spaced apart further than the distance of across the slot in the hub. However, most such open-ended ratchet wrenches are permanently engaged to a single handle or adapted for an engagement at the end of a single handle.

As such, there is a continuing unmet need for an improved open-ended ratchet wrench. Such a wrench should be adaptable to many types of engagements and to multiple handles to allow a single open-ended ratchet head to either fixedly or rotationally engage multiple wrench handles or extensions.

SUMMARY OF THE INVENTION

The device and method herein disclosed and described achieves the above-mentioned goals through the provision of an open-ended ratchet wrench formed as a head portion for engagement to multiple handles. The device employs a housing to operatively engage a hub having an interior portion dimensioned to engage the head of a bolt. The hub has a periphery adapted to function as a ratchet with teeth on the hub circumference, adapted to engage two biased pawls. A casing provides the housing to hold the hub in a rotational engagement and the pawl in a biased translational engagement.

Unlike conventional ratchet open-end wrenches, in the disclosed device, the exterior of the casing is adapted for multiple engagement to multiple wrenches or components.

A first engagement allows for rotation of the wrench head at the distal end of a handle. This side-to-side rotation allows the wrench to engage bolts at odd angles and hard to reach positions.

A second engagement means allows the wrench to be engaged to a conventional ratchet wrench handle or extension, or to a conventional breaker bar or wrench handle. This engagement is provided by an aperture formed through the casing adapted for engagement to a square ratchet wrench head, or extension, or a handle having a square distal end.

As such, the disclosed wrench is multi-functional and mountable to a plurality of different wrenches and handles, to allow the user to adapt the engagement to the task at hand.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of this invention to provide an improved open-ended ratchet wrench that is adapted for rotational engagement at the end of a static handle.

It is an additional object of this invention to provide such a wrench that is concurrently adapted for engagement to a rectangular ratchet wrench or extension or handle.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

FIG. 1 depicts a side view with a partial cut-away showing the pawl engagement with teeth on the exterior circumference of the hub which is rotationally engaged in a casing.

FIG. 1*a* depicts the pawl and tooth engagement.

FIG. 1*b* shows a hub of the device having a open end with a diameter "D" and teeth formed about the exterior circumference.

Figure 3:
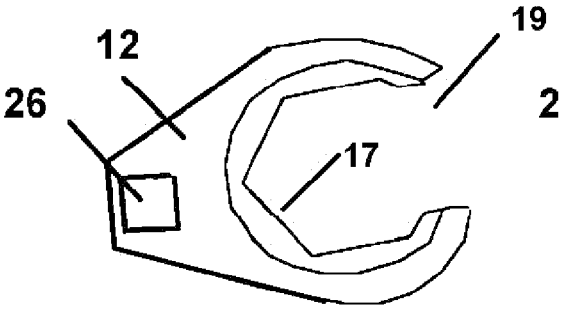
FIG. 3 depicts the device having a hex shaped bolt engaging interior edge having an aperture in the casing configured for engagement to a conventional square ratchet wrench or extension engagement.
Figure 3A:
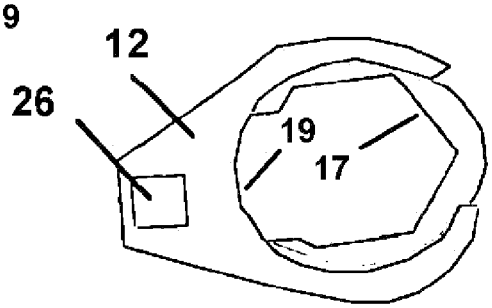

FIG. 3*a* depicts a function common to all modes wherein the open end of the rotating hub portion of the wrench will rotate to close the open end.

Figure 4:
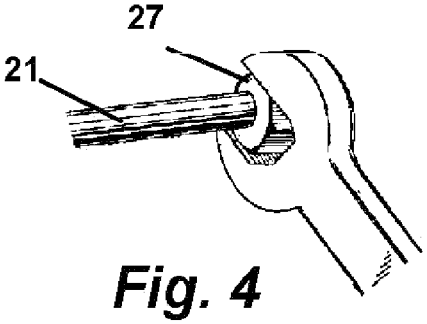
Fig. 4 (prior art)

FIG. 4 shows a conventional open end wrench tightening hex fitting on a tube.

DETAILED DESCRIPTION OF THE PREFERRED EMBODIMENTS OF THE INVENTION

Figure 1:
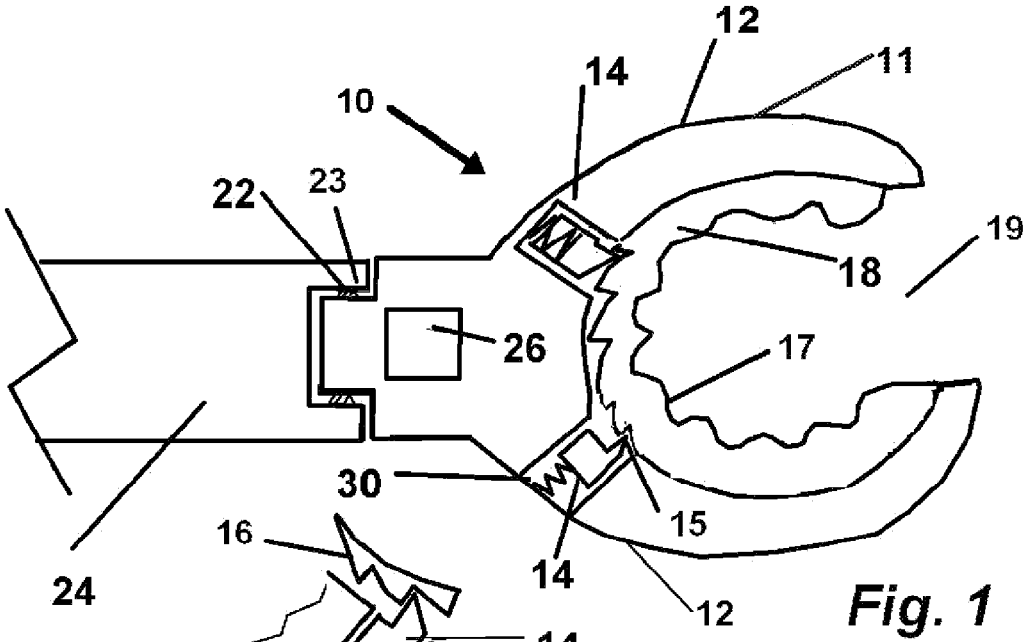
Figure 1A:
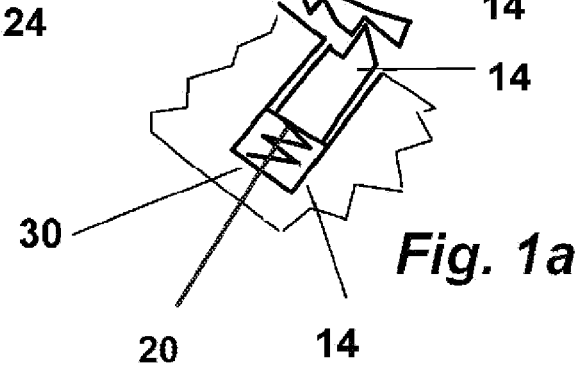

Referring now to the drawings of FIGS. 1-4, the modes of the device 10 are depicted therein. As noted, FIG. 1 depicts a side view of the device 10 showing the head 11 having a partial cut-away of the casing 12 rotationally engaged with a hub 18, and which reveals a biased pawl 14 in a ratcheted engagement with teeth 16 formed about the exterior circumference of the rotationally engaged hub 18. The hub 18 is rotationally engaged in the casing 12 of the head 11, in a conventional fashion with sidewalls of the casing 12 configured to allow the hub 18 to slide there between and rotate. Two pawls 14 are in biased engagements inside slots 20 formed in the casing 12. The distal ends 15 of the pawls 14 are configured to operatively engage the teeth 16 to only allow one way rotation of the hub 18 within its engagement in the casing 12. Means to bias the pawl 14 into the ratcheted engagement with the hub 18 is provided by a spring 30 or may be provided by other biasing means which provides sufficient biasing pressure to the pawl 14.

Figure 1B:
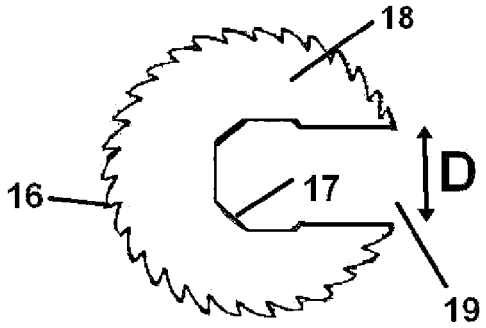

The teeth 16 as shown in FIG. 1*b*, are curved and positioned about the exterior circumference of the hub 18 such that both pawls 14 will normally engage the hub 18 concurrently. The distal ends 15 of the pawls 14, are positioned to be slightly more than the diameter "D" of the open end 19 of the hub 18. This is most important to maintain the ratchet engagement of at least one of the pawls 14 with the teeth 16, when the hub 18 is rotated as in FIG. 3*a*, to position the open end 19 surrounding one of the pawls 14. Since the distance of the distal ends 15 of the pawls 14 is slightly more than "D", one of the pawls 14 is always in the biased ratcheted engagement with the hub 18.

Figure 2:
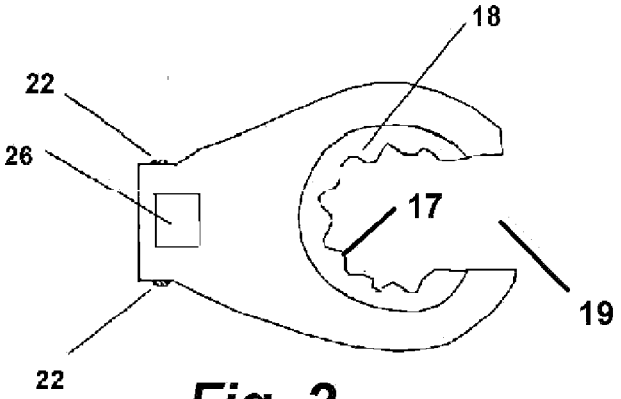
FIG. 2 depicts the device of FIG. 1 with a different bolt engaging interior edge surface, and shows the casing having both biased pin and square aperture engagement components.

In FIG. 2 there is depicted the device 10 similar to that of FIG. 1 having a casing 12 with two means for engagement to a wrench or extension. A first such means is provided by opposing biased pins 22 on opposite sidewalls 13 of the casing 12. These pins 22 project to engage dents 23 on the forked end of a wrench handle 24 such as that of FIG. 1, and allow a side-to-side rotation of the casing 12, during use with the handle 24 which may be included as a kit. The head 11 of FIG. 2 also has a second means for engagement to a handle or wrench in the form of a rectangular aperture 26. Such apertures 26 would be adapted to engage conventional ratchet wrench extensions commonly provided in ¼ inch and ½ inch and ¾ inch sizes. Of course any sized aperture 26 that will engage the distal end of the wrench or extension may be employed. Further, the handle 24 can be made integral to the casing 12 to make a unitary structure of handle and head 11 to form a wrench.

The most preferred mode of the device 10 employs a head 11 having both the rectangular aperture 26 combined with the pins 22 formed on the casing 12. This provides a plurality of ways to engage a single head 11, to multiple handles, extensions, and wrenches, depending on the intended use by the user. As such it is the most useful embodiment of the device 10.

FIG. 3 which shows the head 11 formed by a casing 12 having solely the rectangular aperture 26 for engagement to a wrench or handle or extension. This mode of the device will still allow the head 11 to be engaged to multiple handles or ratchet wrenches or extensions having distal ends adapted for frictional engagement in the aperture 26. The hub 18 as shown in FIGS. 3-3*a*, and typical of all modes of the device 10 herein, rotates 360 degrees in its engagement in the casing 12, and at points along that rotation will block the wrench open end 19. However, as noted, the spacing of the distal ends 15 of the pawls 14 is such that even when the open end 19 of the hub 18 surrounds one of the pawls 14 disengaging it, the other pawl 14 still is in a ratcheted engagement with the hub 18.

In all modes of the device 10 the interior edge 17 of the hub 18 communicating with the open end 19 of the hub 18, is configured to engage the connector 27 or hex bolt shape, or exterior edge, of the fitting to be turned by the device 10. All modes of the device 10 also have an open end 19 having a minimum diameter distance "D" sized to slide over a tubing member 21. Thereafter, the interior edge 17 is engaged on the tubing connector 27 or exterior surface of the fitting or other tube connector. Turning the connector 27 does not require removal of the head 11 or handle 24 as is normally required in prior art as shown in FIG. 4 where a conventional wrench must continually be removed and re-engaged to turn the connector 27.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A kit for rotation of tubing connectors rotationally engaged upon tubing, comprising:

an open end wrench casing;

a swivel handle, said swivel handle having a forked end having a recess formed between opposing sidewalls of two forks; and a wrench extension member;

said wrench casing comprises a wrench head having a first end opposite a second end and having a first side surface and second side surface both respectively extending between said first end and said second end of said wrench head;

a hub, said hub having an exterior circumference, and having an interior aperture defined by an interior aperture edge surface of said hub;

a gap communicating between said interior aperture and said exterior circumference;

said hub rotationally engaged within a head aperture formed at a first end of said wrench head, said head aperture having an opening communicating between said head aperture and an exterior surface of said wrench head;

said opening having an opening diameter sized at least as large as a diameter of said gap;

means for a ratcheted engagement of said hub within said head aperture whereby said hub turns freely in only one rotational direction;

said interior aperture edge surface forming an aperture shape which is complimentary to an exterior shape of an exterior surface of said tubing connectors;

said wrench head having a projection extending away from said second end of said wrench head opposite said gap at said first end of said wrench head, said projection having opposing sidewalls communicating between a first side of said projection running parallel with said first side surface of said wrench head and a second side of said projection running parallel with said second side surface of said wrench head;

said sidewalls of said projection removably engageable in a swiveling engagement between said two forks of said swivel handle;

a wrench extension aperture communicating between said first side surface and second side surface of said wrench head, said wrench extension aperture formed in said wrench head between said second end and said head aperture, said wrench extension aperture configured to removably engage upon a distal end of said wrench extension member which is rotatable by a handle engageable at a first end of said extension member;

said interior aperture positionable to a removable engagement of said aperture edge surface with said exterior surface of said tubing connector;

said wrench head with said interior aperture in said removable engagement being rotatable by said swivel handle engaged with said projection at said second end thereof; and said wrench head with said interior aperture in said removable engagement being rotatable by rotation of said extension member engaged with said wrench extension aperture.

2. The kit of claim 1 wherein said means for ratcheted engagement of said hub within said head aperture comprises:

a first pawl, said first pawl having a first end and a distal end;

said first pawl engaged within a cavity in said wrench head, said cavity communicating with said head aperture;

means to bias said first pawl at said first end, and thereby cause a translation of said distal end toward said hub; and means to engage said distal end of said first pawl with said exterior circumference of said hub.

3. The kit of claim 2 wherein said means for ratcheted engagement of said hub within said head aperture additionally comprising:

a second pawl, said second pawl having a first end and a distal end;

said second pawl engaged within a second cavity in said wrench head, said second cavity communicating with said head aperture;

means to bias said second pawl at said first end, and thereby cause a translation of said distal end toward said hub;

means to engage said distal end of said second pawl with said exterior circumference of said hub; and said pawl and said second pawl positioned at a spacing from each other, said spacing being slightly larger than said opening diameter.

4. The kit of claim 1 wherein said swiveling engagement of said sidewalls of said projection extending away from said second end of said wrench casing between said two forks comprises:

a pair of biased opposing pins engaging respective detents in respective positions in between said sidewalls on said projection extending from said second end of said wrench head and said opposing sidewalls of said two forks.

5. The kit of claim 2 wherein said swiveling engagement of said sidewalls of said projection extending away from said second end of said wrench casing between said two forks comprises:

a pair of biased opposing pins engaging respective detents in respective positions in between said sidewalls on said projection extending from said second end of said wrench head and said opposing sidewalls of said two forks.

6. The kit of claim 3 wherein said swiveling engagement of said sidewalls of said projection extending away from said second end of said wrench casing between said two forks comprises:

a pair of biased opposing pins engaging respective detents in respective positions in between Said sidewalls on said projection extending from said second end of said wrench head and said opposing sidewalls of said two forks.

7. The kit of claim 1 wherein said swiveling engagement of said projection extending away from said second end of said wrench casing between said two forks comprises:

a biased pin extending from a first said side wall of said projection extending from said second end of said wrench head;

a second biased pin extending from a second said side wall of said projection extending from said second end of said wrench head opposite said first side surface of said projection; and detents formed in said opposing sidewalls of said two forks, said detents positioned to engage with a respective one of said first biased pin or second biased pin with said projection extending away from said second end of said wrench head in said swiveling engagement.

8. The kit of claim 2 wherein said swiveling engagement of said projection extending away from said second end of said wrench casing between said two forks comprises:

a biased pin extending from a first said side wall of said projection extending from said second end of said wrench head;

a second biased pin extending from a second said side wall of said projection extending from said second end of said wrench head opposite said first side surface of said projection; and detents formed in said opposing sidewalls of said two forks, said detents positioned to engage with a respective one of said first biased pin or second biased pin with said projection extending away from said second end of said wrench head in said swiveling engagement.

9. The kit of claim 3 wherein said swiveling engagement of said projection extending away from said second end of said wrench casing between said two forks comprises:

a biased pin extending from a first said side wall of said projection extending from said second end of said wrench head;

a second biased pin extending from a second said side wall of said projection extending from said second end of said wrench head opposite said first side surface of said projection; and detents formed in said opposing sidewalls of said two forks, said detents positioned to engage with a respective one of said first biased pin or second biased pin with said projection extending away from said second end of said wrench head in said swiveling engagement.

* * * * *